US009522766B2

(12) United States Patent
Bechtold et al.

(10) Patent No.: US 9,522,766 B2
(45) Date of Patent: Dec. 20, 2016

(54) POUCH WITH ABSORBENT LINER AND METHOD OF FORMING

(71) Applicant: BullSpitt, LLC, Bradenton, FL (US)

(72) Inventors: Richard E. Bechtold, Bradenton, FL (US); R. Charles Murray, Sarasota, FL (US)

(73) Assignee: BullSpitt, LLC, Bradenton, FL (US)

( * ) Notice: Subject to any disclaimer, the term of this patent is extended or adjusted under 35 U.S.C. 154(b) by 0 days.

(21) Appl. No.: 14/607,589

(22) Filed: Jan. 28, 2015

(65) Prior Publication Data

US 2015/0210436 A1 Jul. 30, 2015

Related U.S. Application Data

(60) Provisional application No. 62/033,925, filed on Aug. 6, 2014, provisional application No. 61/932,910, filed on Jan. 29, 2014.

(51) Int. Cl.
*B65D 30/22* (2006.01)
*B65D 75/58* (2006.01)
*B65D 81/26* (2006.01)

(52) U.S. Cl.
CPC ..... *B65D 31/12* (2013.01); *B65D 75/5883* (2013.01); *B65D 81/264* (2013.01)

(58) Field of Classification Search
CPC ..... B65D 31/12; B65D 39/00; B65D 75/008; B65D 33/16; B32B 37/142; B32B 37/1284; B32B 37/18; B32B 2307/726; B32B 2439/00
USPC ..... 383/38–40, 104, 80, 200
See application file for complete search history.

(56) References Cited

U.S. PATENT DOCUMENTS

| | | | | | |
|---|---|---|---|---|---|
| 630,225 | A | | 8/1899 | Murray | |
| 700,733 | A | | 5/1902 | Murray | |
| 4,884,717 | A | * | 12/1989 | Bussard | B65D 47/06 220/229 |
| 4,885,809 | A | | 12/1989 | Muchmore | |
| 5,261,532 | A | * | 11/1993 | Fauci | A45C 11/20 206/217 |
| 5,832,543 | A | | 11/1998 | Bosserman | |
| 5,961,501 | A | * | 10/1999 | Cassidy | A61F 5/445 604/317 |
| 6,279,581 | B1 | * | 8/2001 | Knepper | A24F 15/18 131/290 |
| 6,398,071 | B1 | * | 6/2002 | Fellers | A47F 1/08 221/174 |
| 6,718,563 | B1 | * | 4/2004 | Kreiensieck | A61J 19/00 4/258 |
| 7,055,683 | B2 | * | 6/2006 | Bourque | B29C 65/76 206/219 |
| 7,066,322 | B2 | * | 6/2006 | Wilson | A47G 19/22 206/217 |
| 8,074,841 | B1 | * | 12/2011 | Craig | A47G 19/30 220/23.83 |
| 9,334,087 | B2 | * | 5/2016 | Cho | B65D 81/3484 |

(Continued)

*Primary Examiner* — Jes F Pascua
(74) *Attorney, Agent, or Firm* — Todd Partners, P.C.; Jack D. Todd

(57) ABSTRACT

The present disclosure is directed to a flexible pouch including a first chamber and a second chamber. The first chamber is separated from the second chamber by a seal. The first chamber has a fitment with an opening permitting access to the first chamber. The first chamber also has an absorbent material which is affixed to the pouch.

20 Claims, 7 Drawing Sheets

(56) References Cited

U.S. PATENT DOCUMENTS

| | | | | |
|---|---|---|---|---|
| 2002/0020008 | A1 | 2/2002 | Nguyen | |
| 2005/0109796 | A1* | 5/2005 | Bourque | B65D 81/3261 222/94 |
| 2005/0161424 | A1* | 7/2005 | Hogan | B65D 21/0202 215/10 |
| 2006/0101564 | A1* | 5/2006 | Powdermaker | A61J 19/00 4/259 |
| 2006/0196784 | A1 | 9/2006 | Murray | |
| 2008/0159660 | A1* | 7/2008 | Roell, III | B65D 81/2038 383/40 |
| 2008/0226200 | A1 | 9/2008 | Murray | |
| 2009/0120931 | A1 | 5/2009 | Murray | |
| 2009/0255626 | A1 | 10/2009 | Murray | |
| 2012/0269462 | A1* | 10/2012 | Itiyanagi | B65D 33/2508 383/64 |
| 2015/0108015 | A1* | 4/2015 | Murray | B31B 1/00 206/205 |
| 2015/0158635 | A1* | 6/2015 | Gum | B65D 75/008 383/25 |
| 2015/0307233 | A1* | 10/2015 | Murray | B65D 31/12 383/38 |
| 2016/0039575 | A1* | 2/2016 | Murray | B65D 27/08 206/204 |

* cited by examiner

FIG. 5
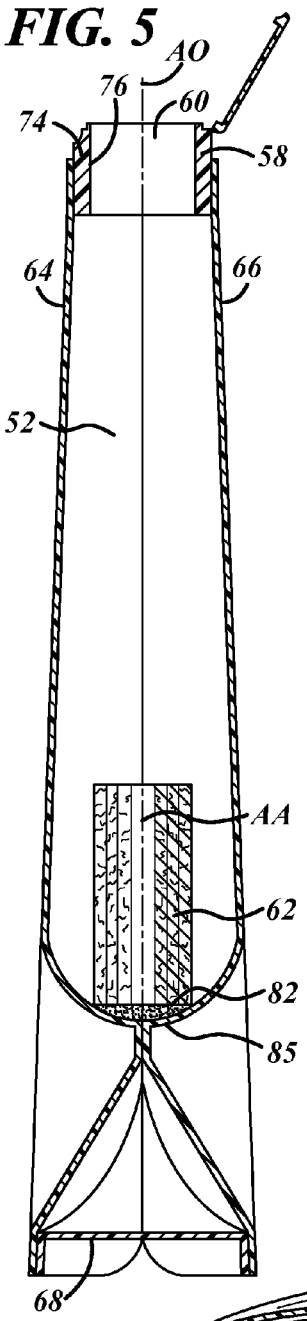
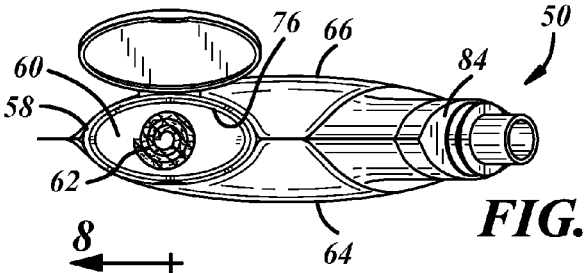
FIG. 4
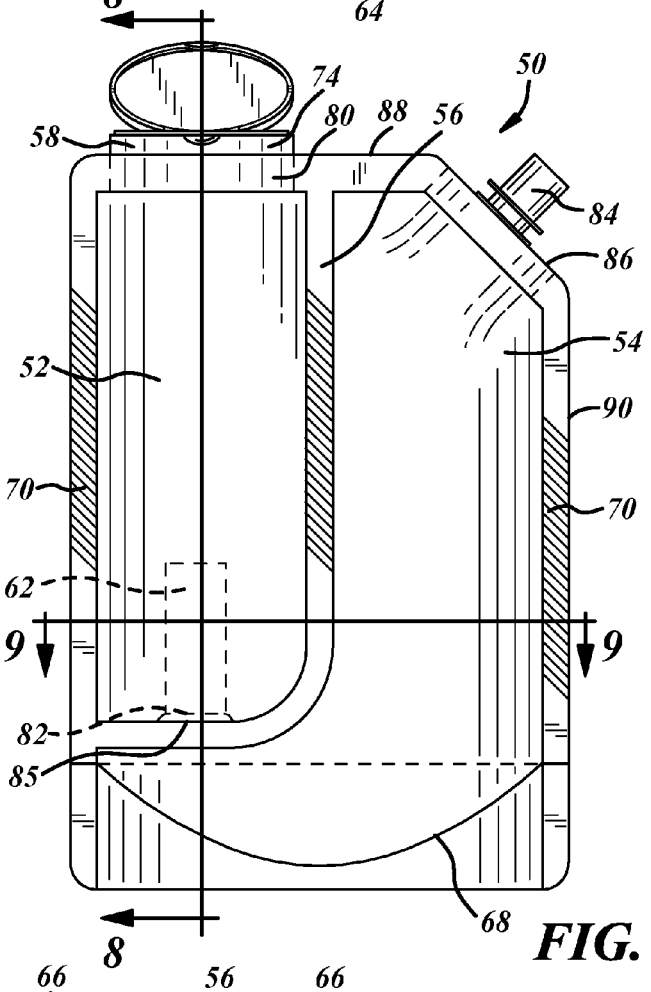
FIG. 7
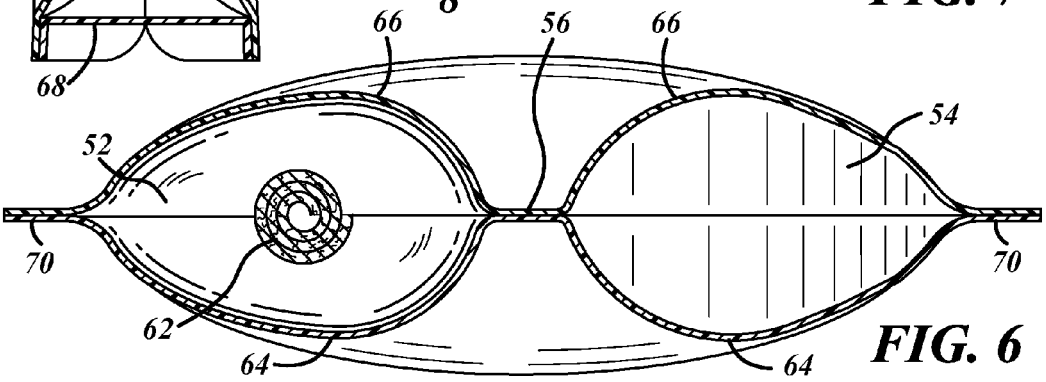
FIG. 6

POUCH WITH ABSORBENT LINER AND METHOD OF FORMING

CROSS-REFERENCE TO RELATED APPLICATIONS

This application claims priority of U.S. Provisional Patent Application Ser. No. 61/932,910 filed on Jan. 29, 2014, and priority of U.S. Provisional Patent Application Ser. No. 62/033,925 filed on Aug. 6, 2014, both of which are incorporated herein by reference.

FIELD OF THE INVENTION

The present invention relates to container products. Specifically, to flexible pouches designed to hold and retain liquid.

BACKGROUND OF THE INVENTION

Generally, flexible laminate pouches are known in the art. Such pouches traditionally have sealed sides and bottom and a sealed top which can either have a tear off portion or a specialized fitment with a cap which is attached via a threaded or snap mechanism. Traditionally these pouches have been designed to hold consumer products such as granular solids or liquid materials, the pouch and fitment being operable to hold the material until the consumer desires to access the product wherein the consumer can remove the product through the fitment, the fitment being resealable. One such example for a flexible pouch can be found in U.S. Pat. No. 7,661,560, incorporated herein by reference.

The flexible pouch is traditionally made from a flexible material, preferably a laminate composed of sheets of plastic or alumina or the like. This material is usually available in a rolled form which is then unrolled and formed into the pouch. An outer layer of the material may be preprinted with information such as a logo or the like and may provide the consumer with information regarding the contents of the pouch.

A problem exists in that these pouches traditionally are made to have product removed but not refilled and if product is refilled it is usually freely removable. This can create a problem wherein the consumer desires to put a liquid product into the pouch and have it be restrained from exiting the pouch. One example of such product to be put into a pouch to be restrained is tobacco spit. Thus, there is a need in the art for a flexible pouch with a sealable cap that retains liquid product regardless of the state of the cap. Additional improvements are also desired, such as containing contents in the pouch other than what is restrained liquid, which will become apparent in the following disclosure.

SUMMARY OF THE INVENTION

The claims of the present disclosure are directed to a flexible pouch including a first chamber and a second chamber. The first chamber is separated from the second chamber by a seal. The first chamber has a fitment with an opening permitting access to the first chamber. The first chamber also has an absorbent material which is affixed to the pouch.

The claims of the present disclosure are also directed to a method of manufacturing a flexible pouch with a secured absorbent material. The step of the method include providing a flexible pouch with chamber having an opening and a bottom, and a generally cylindrical shaped piece of absorbent material with an end. After the pouch and absorbent material are provided, adhesive is applied to the end of the absorbent material. Next, the absorbent material is inserted into the flexible pouch through the opening, and the end of the absorbent material is pressed to the bottom of the chamber.

BRIEF DESCRIPTION OF THE DRAWINGS

FIG. 4 is a top view of the first embodiment;

FIG. 5 is a sectional side view of the first embodiment;

FIG. 6 is a sectional top view of the first embodiment;

FIG. 7 is a sectional view of a second embodiment of the flexible pouch;

DETAILED DESCRIPTION OF THE PREFERRED EMBODIMENTS

Figure 1:
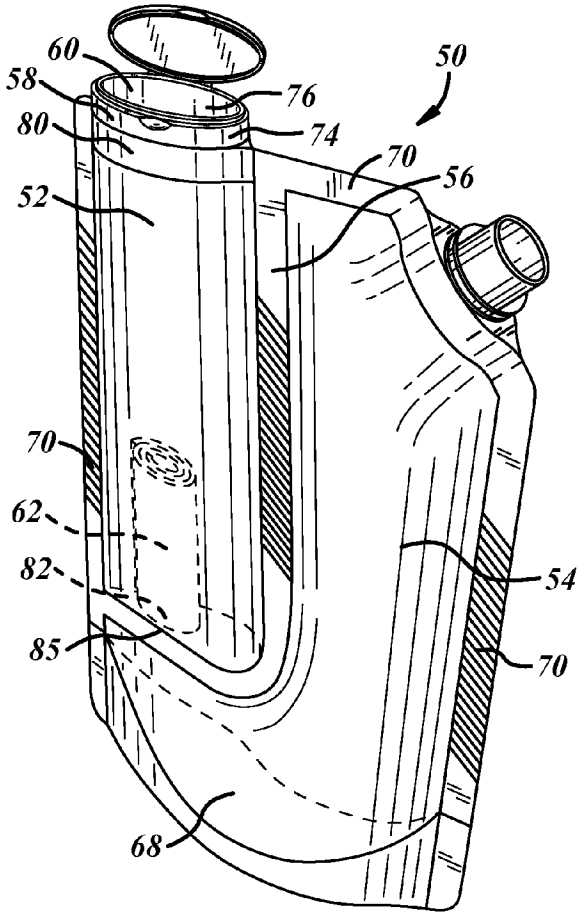
FIG. 1 is a front perspective view of a first embodiment of a flexible pouch.
Figure 2:
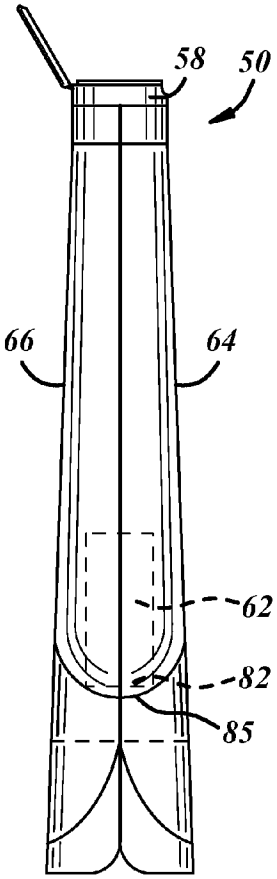
FIG. 2 is a side view of the first embodiment.
Figure 3:
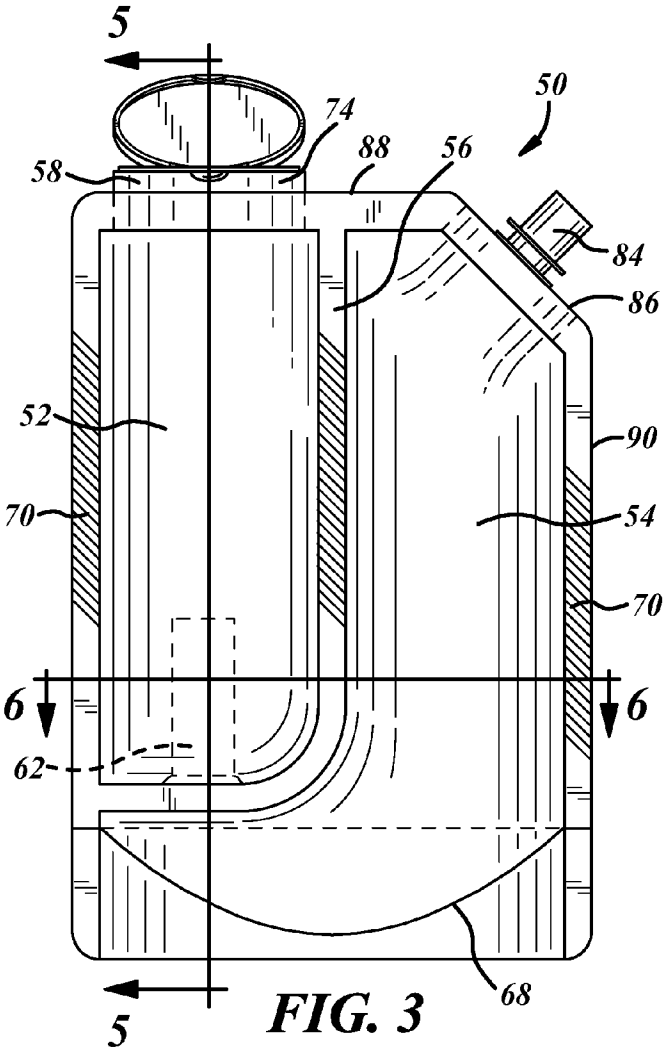
FIG. 3 is a front view of the first embodiment.

The described embodiments help to retain liquid inside of a flexible pouch, and also are able to store additional contents separate from the retained liquid. The disclosure provides for a flexible pouch design to receive an undesirable liquid or other material, such as tobacco spit, while at the same time containing another liquid to be used or consumed by a user of the pouch, such as water. To achieve both these goals, the flexible pouch includes at least two chambers. The chambers are designed such that they are not in communication with each other, and material in one chamber cannot enter the other chamber.

A flexible pouch 50 includes a first chamber 52 that is separated from a second chamber 54 by a barrier seal 56. Access to the first chamber is provided by a fitment 58 of the first chamber 52. The fitment 58 includes an opening 60. Absorbent material 62 is affixed to the flexible pouch 50 within the first chamber, as shown in FIGS. 1-16.

The pouch 50 may be formed and/or filled using conventionally known manufacturing techniques such as a horizontal form fill seal machine with single or multiple lanes, a flatbed pouch machine, a vertical form fill machine, or the like.

The flexible pouch 50 includes a front panel 64 and a back panel 66. The pouch 50 may further include a gusset 68 along a bottom edge 69 of the pouch 50. The front panel 64, back panel 66 and gusset 68 are joined together by a perimeter seal 70.

To separate the first chamber 52 from the second chamber 54, the front panel 64 may be sealed to the back panel 66 to form the barrier seal 56, thereby enclosing a volumed define by the first chamber 52 between the front panel 64 and the back panel 66 along the barrier seal 56 and portions of the perimeter seal 70, as shown in FIGS. 4 and 6

Figure 9:
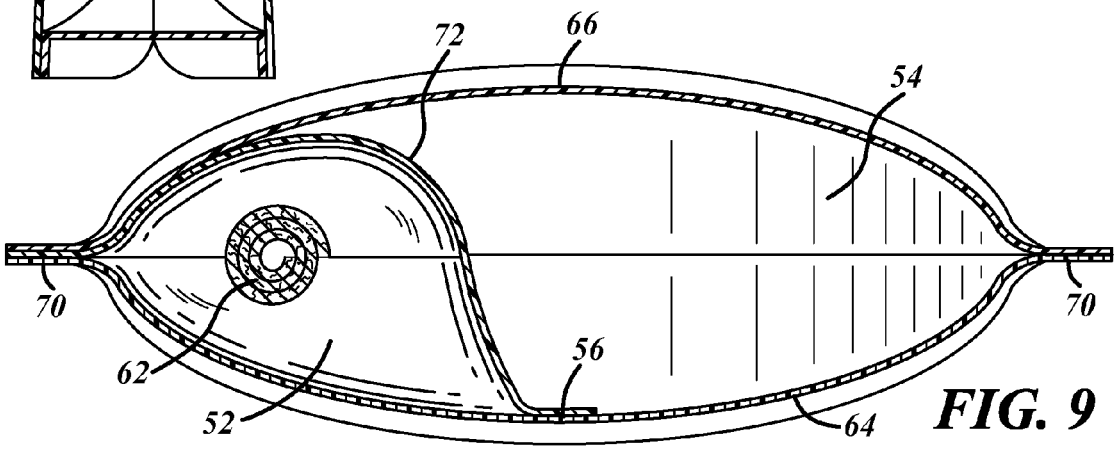
FIG. 9 is a sectional top view of the second embodiment.

Alternately, the flexible pouch 50 may additionally include a middle panel 72 sealed to the front panel 64 or the back panel 66 along the barrier seal 56 and portions of the perimeter seal 70, thereby enclosing a volume within the first chamber 52 between the middle panel 72 and the front panel 64 or the back panel 72, as shown in FIGS. 5 and 9.

The various panels may be made of a flexible laminate material, preferably an extrusion or a laminate composed of sheets of plastic and aluminum or the like, and sealed using ultrasonic welding, applying heat and pressure to the area to be sealed, or with any other suitable material, and method known to those skilled in the art. An outer layer of material may include preprinted information such as a logo or the like to provide the customer with information regarding the contents of the pouch.

The first chamber 52 and second chamber 54 of the flexible pouch 50 abut each other and are orientated generally such that the chambers 52 54 run in a top to bottom fashion of the pouch 50.

The fitment 58 of the first chamber 52 includes a tube spout 74 with an interior surface 76. The interior surface 76 has an oval shape when viewed from the top. The interior surface 76 of the fitment 58 extends along the tube spout 74 defining the opening 60. The fitment 58 is located along a top sealed edge 78 of the first chamber 52 between the front panel 64 and the back panel 66, or the middle panel 72 and the front panel 64 or back panel 66. The fitment 58 includes a canoe portion 80. The canoe 80 is sealed to the various panels with sealing methods described above. The fitment 58 may be made of injection molded plastic, or any other suitable material known to those skilled in the art.

One type of absorbent material 62 that may be secured within the first chamber 52 is a cotton roll having a generally cylindrical shape, as shown in FIGS. 1-10. To secure the cotton roll, adhesive such as glue may be applied to an end 82 of the cylindrical shaped absorbent material 62. The end 82 is secured with the adhesive to a bottom portion 84 of the first chamber 52.

Figure 8:
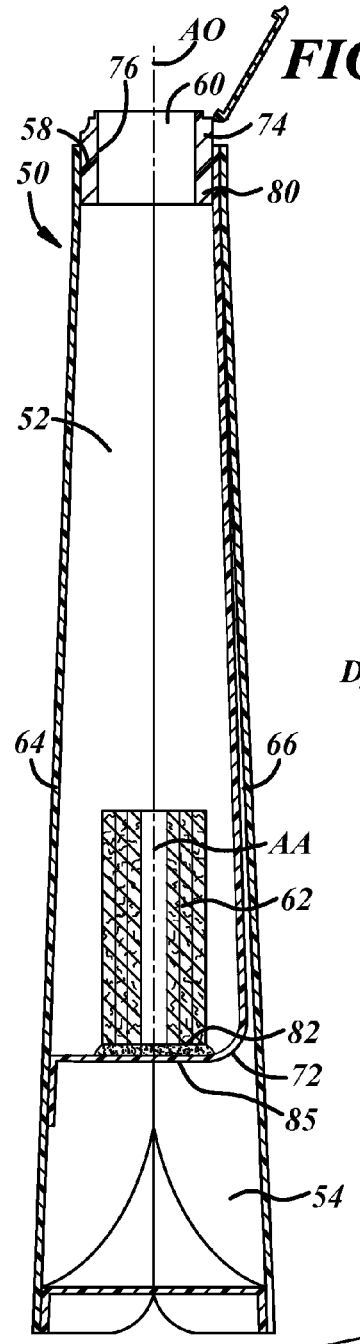
FIG. 8 is a sectional side view of the second embodiment.
Figure 10:
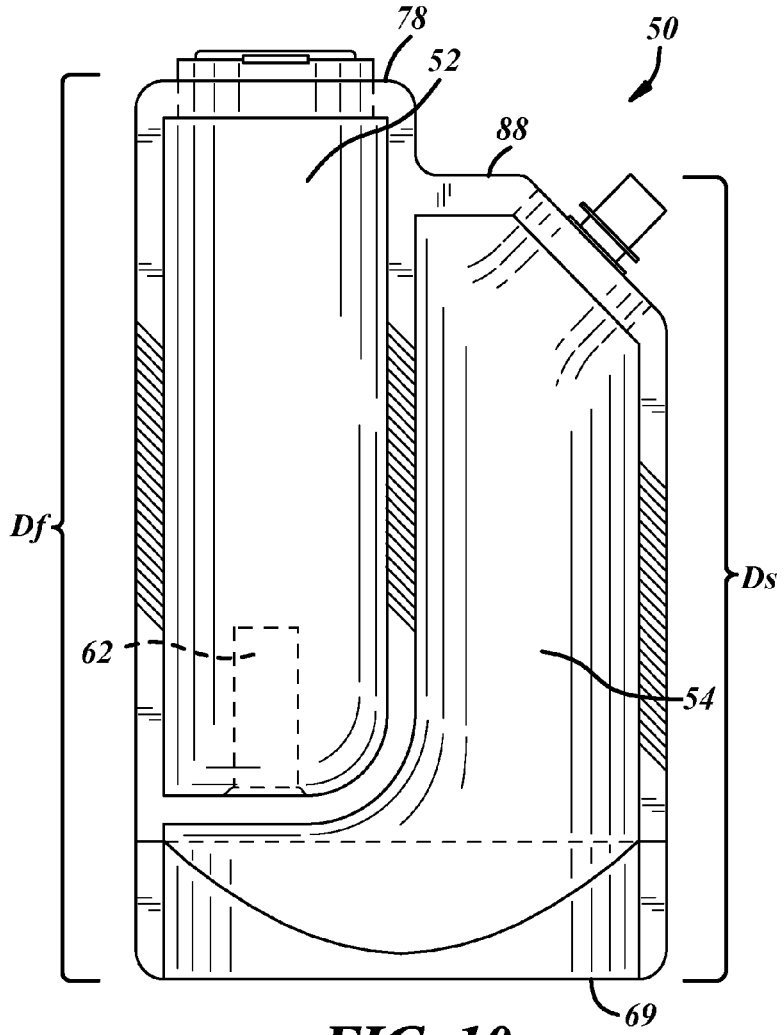
FIG. 10 is a front view of a third embodiment of the flexible pouch.

With reference to FIGS. 5 and 8, the opening 60 of the fitment 58 has an axis AO that runs along the axial (as opposed to radial) direction of the oval shaped inside surface 76 of the tube spout 74. The absorbent material 62 has axis AA that runs along the axial (as opposed to radial) direction of the cylindrical shape of the cotton roll. The axis AO of the opening 60 is generally parallel to the axis AA of the absorbent material 62 when the generally cylindrical in shape cotton roll is used as the absorbent material 62, and secured to the bottom portion 84 of the first chamber 52.

Use of the cotton roll for the absorbent material is beneficial because it may be inserted after the flexible pouch 50 has been formed. To provide such installation, the cotton roll is inserted through the opening 60 in the fitment 58.

With reference now to FIGS. 11-16, as an alternative, the absorbent material 62 may be in sheet form such as a cotton batting type material, a cellulose or other paper type material, or any other suitable absorbent material in a flat sheet like form. The sheet like absorbent material 62 may be secured along the inside surface of the first chamber 52, for example on the front panel, back panel, or middle panel. One such method of securing the sheet form absorbent material 62 would be to apply the absorbent material to the panel before the flexible pouch 50 was formed.

A scented oil may be applied to the absorbent material 62 or the adhesive securing it in place to help mask or reduce any odor generated by contents, such as tobacco spit, deposited into the first chamber 52.

The second chamber 54 may also include a fitment 84. The fitment 84 may include a tube spout and an opening with a screw on, flip top, or other re-sealable cap. The second chamber 54 may be used to store water, sports drink, juice, mouthwash or other liquid, for a user. Access to the contents of the second chamber 54 provided by the opening in the fitment 84.

The fitment 54 of the second chamber may be sealed between the front panel 64 and back panel 66, located along an angled edge 86 of the perimeter of the second chamber 54. The angled edge 86 runs between, and connects, a top edge 88 and a side edge 90 of the perimeter of the second chamber.

Locating the fitment 84 on the angled edge 86 allows a user of the pouch to easily differentiate between the first chamber 52 and second chamber 54, thereby helping to prevent either depositing material into the second chamber 54 or consuming material from the first chamber 52. Further, orientating the fitment 84 in such a manner allows material to be removed from the fitment 84 of the second chamber 54 without fully inverting the flexible pouch 50.

Figure 14:
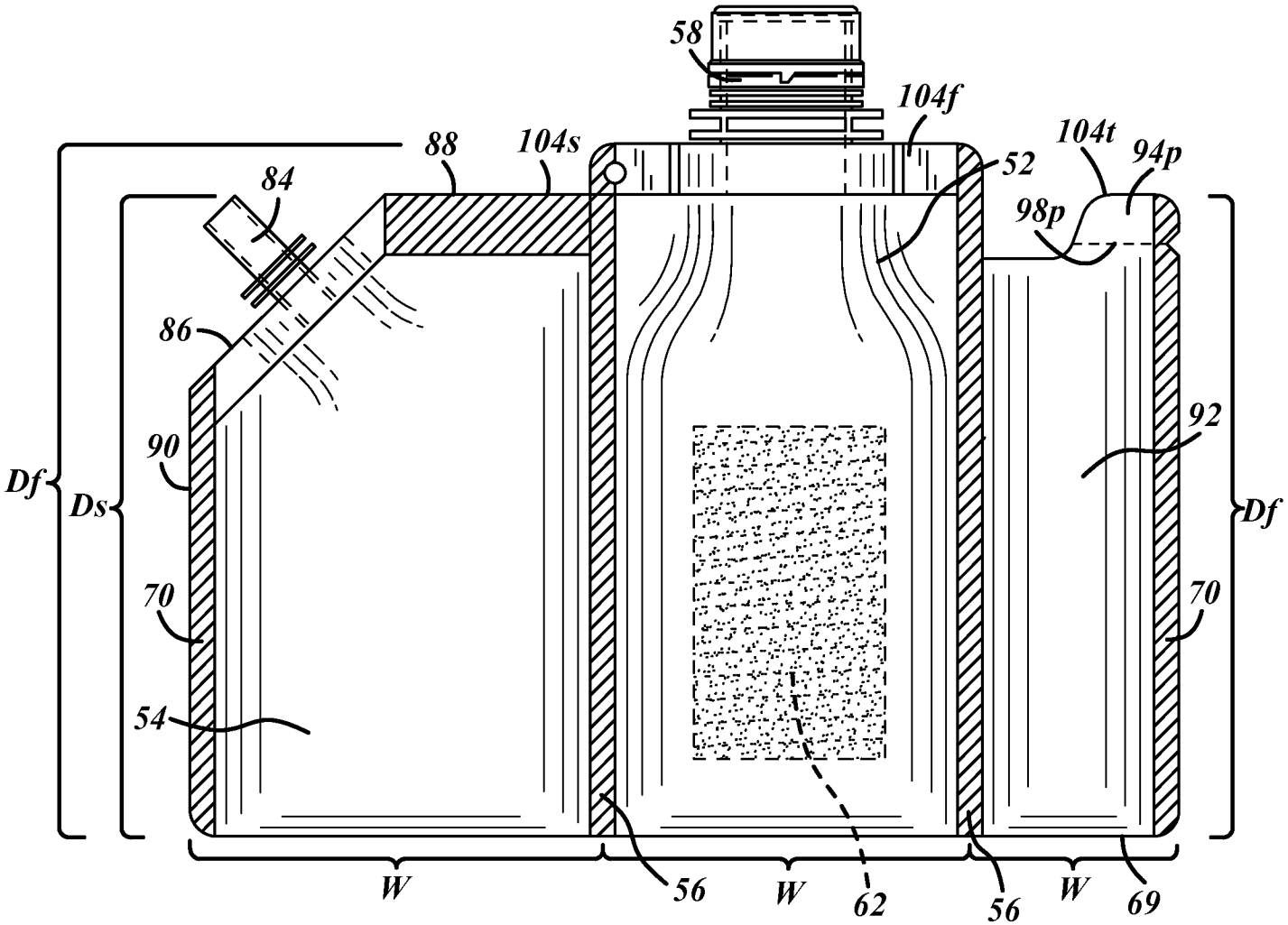
FIG. 14 is a front view of a sixth embodiment of the flexible pouch.

As shown in FIG. 14, the flexible pouch may include a third chamber 92. The third chamber 92 is separated from the first chamber by another barrier seal 56. The third chamber 92 is further defined by its perimeter seal, similar to the first chamber 52 and second chamber 54.

The second chamber 54 or third chamber 92 may also include a tear away portion 94. The tear away portion 94 help to make the chamber 54 92 ideal for hold solid, granular, or gel materials. For example, a package of gum, a can of tobacco, loose tobacco, rolling papers, etc.

The tear away portion 94 may be a partial tear away **94*p*, or a full tear away 94*f*. The tear away portion 94** may run horizontally, vertically, or other direction.

Figure 13:
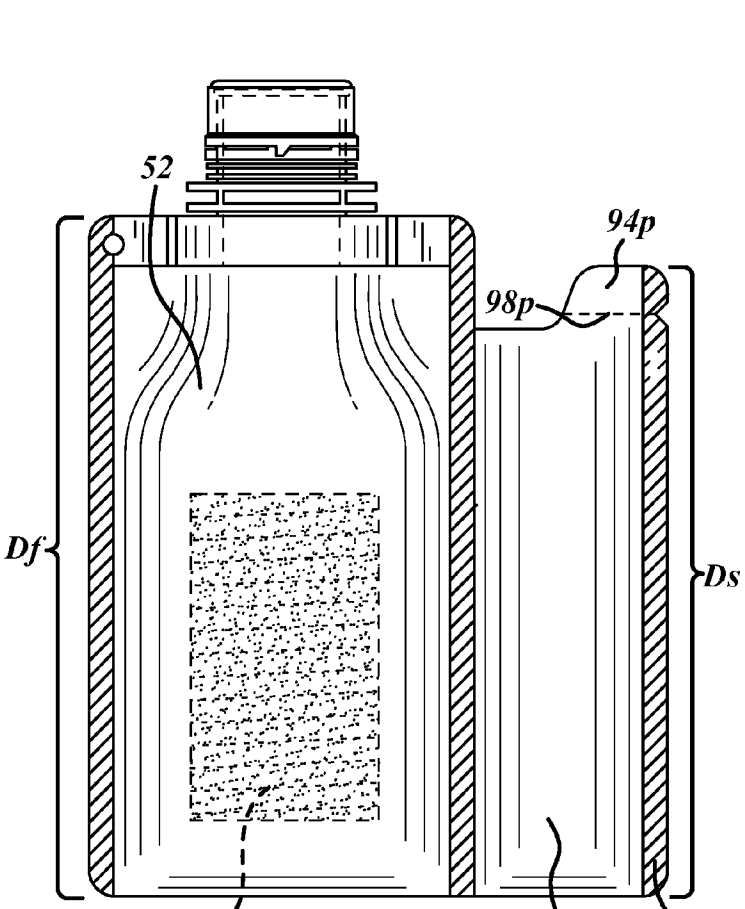
FIG. 13 is a front view of a fifth embodiment of the flexible pouch.
Figure 12:
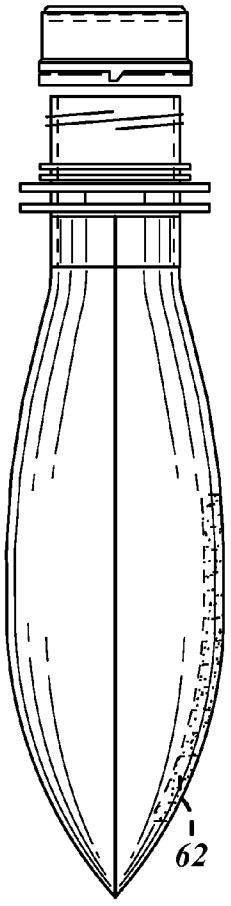
FIG. 12 is a side view of the fourth embodiment.

With reference to FIGS. 13 and 14, the partial tear away portion **94*p* allows a user to see the product contained within the chamber 54 92 when the flexible pouch 50 is initially purchased before the partial tear away portion 94*p* is removed. This is provided by the chamber 54 92 having a sleeve like design where a top of the third chamber is open adjacent the partial tear away portion 94*p*. Thus the flexible pouch 50 can be coupled with known products such as a package of gum or cigarette papers so that the user can see the specific branded good contained within chamber 54 92 at the time of purchase. The partial tear away portion 94*p* is removed by use of the tear notch 96 and perforated strip 98*p***.

Figure 11:
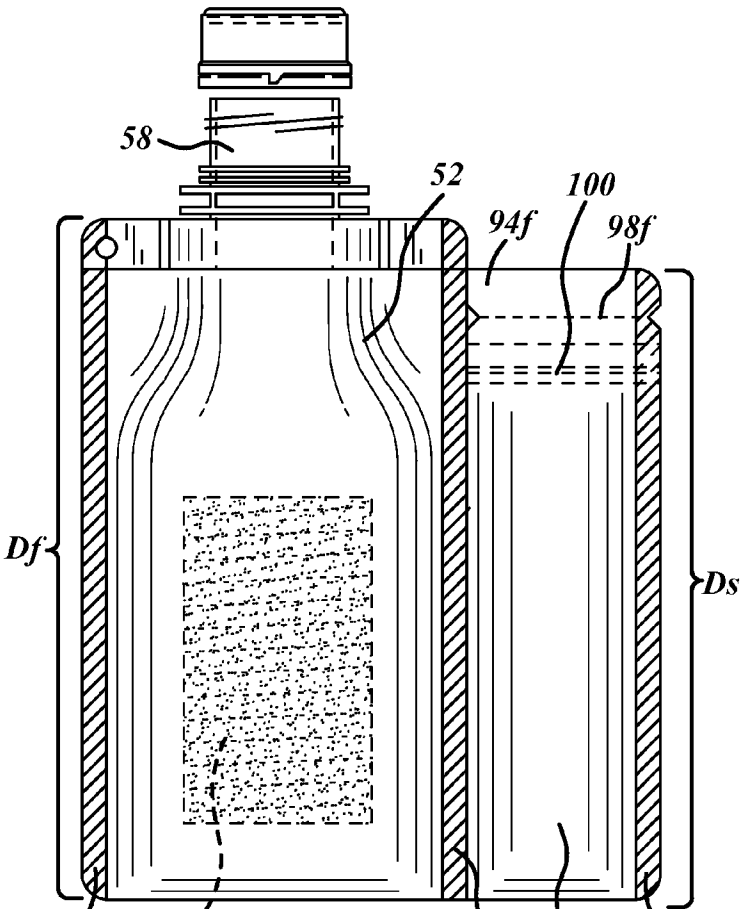
FIG. 11 is a front view of a fourth embodiment of the flexible pouch.
Figure 15:
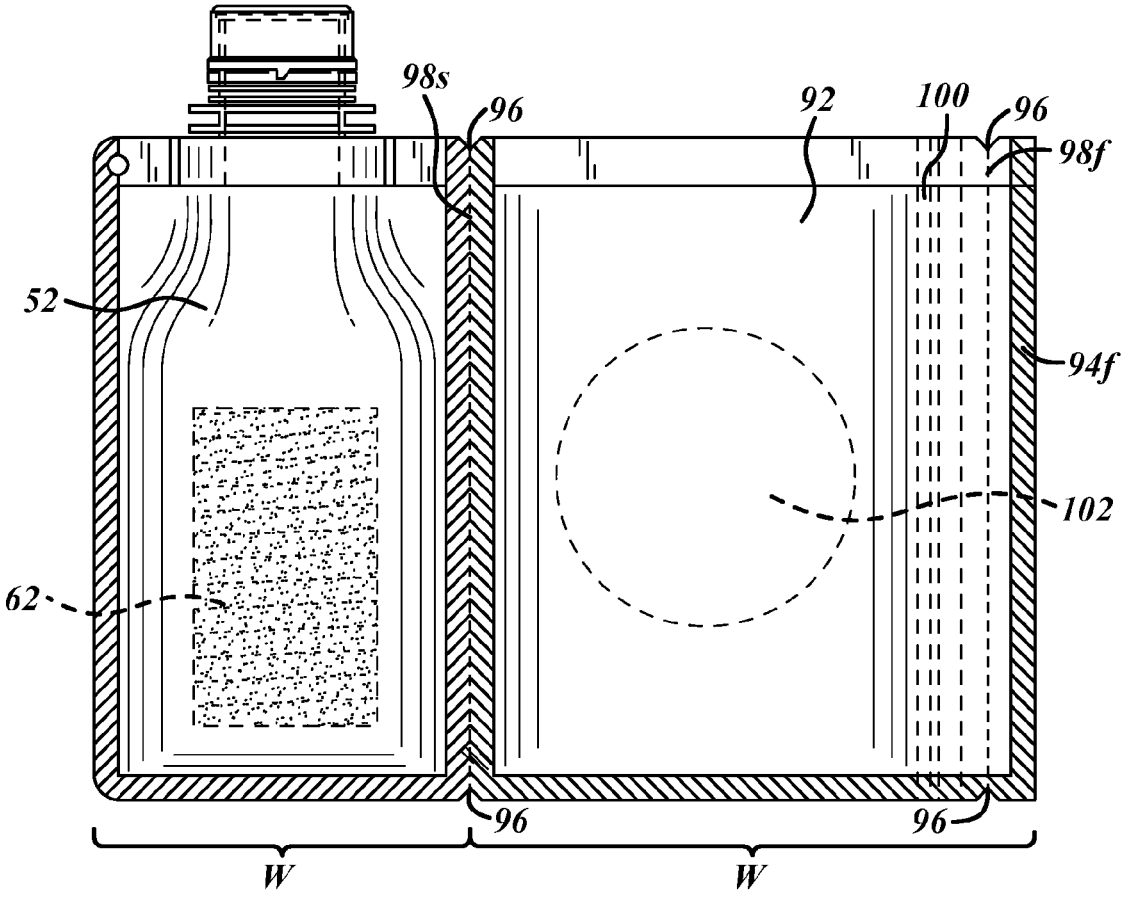
FIG. 15 is a front view of a seventh embodiment of the flexible pouch.

With reference to FIGS. 11 and 15, the chamber 54 includes full tear away portion **94*f* and side re-sealable strip 100. The full tear away portion 94*f* and side re-sealable strip 100 runs adjacent to the top 88, or from the top 88 to the bottom the chamber 54, thereby providing access to items stored in the chamber 92. To access contents, the full tear away portion 94*f* is removed via perforation 98*f*, and the re-sealable strip 100. When user is completed adding or removing contents, they may reseal the re-sealable strip 100. Locating the side re-sealable strip 100 so that it runs from the top to bottom, when the chamber 54 is taller than it is wide, will provide a large opening to access products within the third chamber 92, such as a can of tobacco 102**. Examples of re-sealable strips include a press-to-close type closure, a re-sealable adhesive type closure, a Velcro type closure, double-sided tape, or any other similar type closure known to those skilled in the art.

Figure 16:
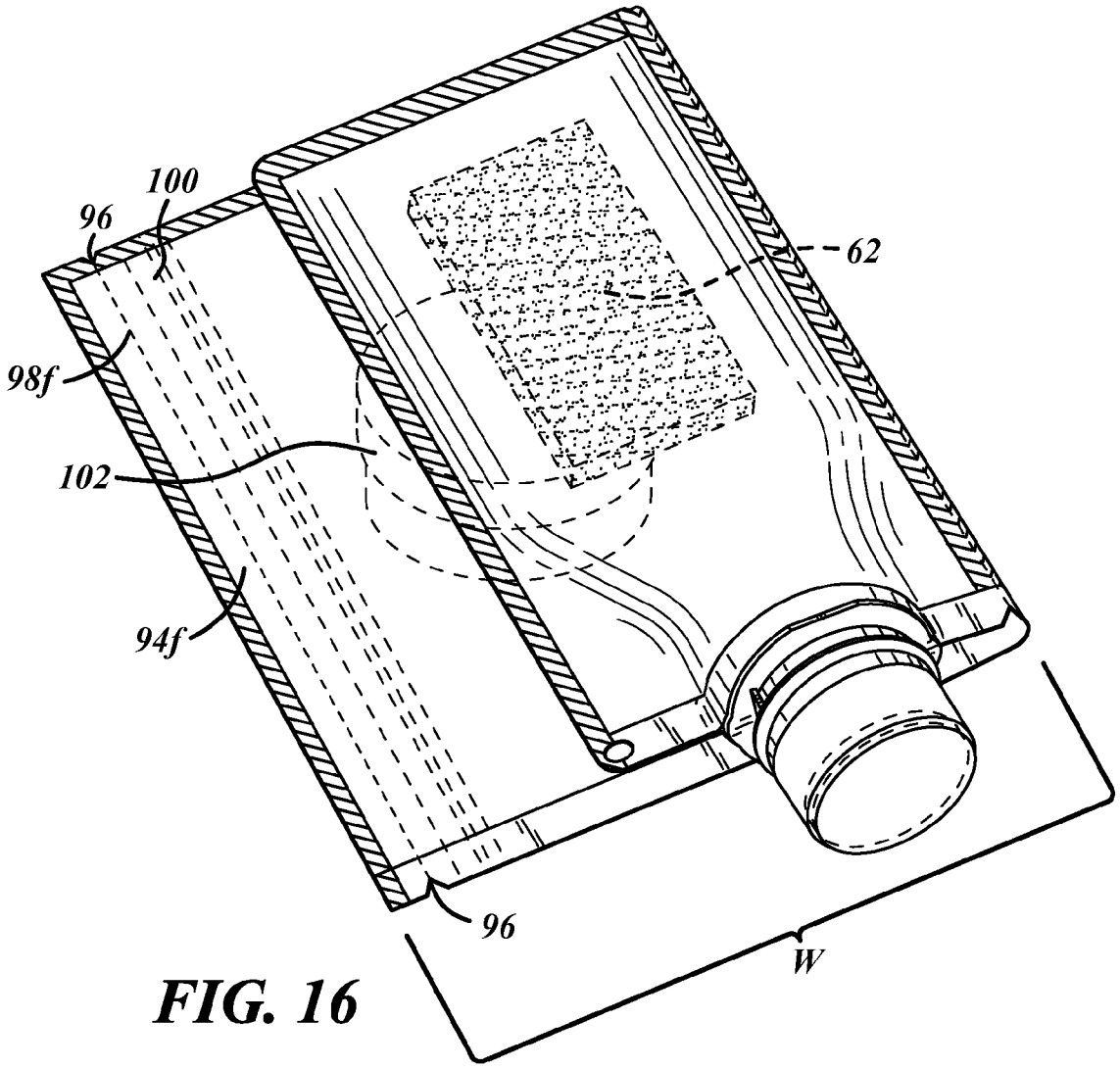
FIG. 16 is a perspective view of the seventh embodiment in a folded state.

With reference now to the pouch 50 shown in FIGS. 15 and 16, the barrier seal 56 includes a perforated strip 98*s*. The perforated strip 98*s* runs generally the length of the barrier seal 56. The perforated strip 98*s* allows the chambers located on either side of the perforated strip 98*s* to be separated from each other, thereby creating two individual pouches simply by tearing along the perforated strip 98*s*. Tearing the perforated strip 98*s* is made convenient for the user by the included tear notch 96.

With reference to FIGS. 10, 11, 13 and 14, the first, second and third chambers 52 54 92 each include a top edge 104*f* 104*s* 104*t*, respectively. The distance Df from the bottom edge 69 of the flexible pouch 50 to the top edge 104*f* of the first chamber 52 is greater than the distance Ds Dt from the bottom edge 69 of the flexible pouch 50 to the top edge 104*s* of the second chamber 54 or the top edge 104*t* of the third chamber 92. This greater distance provides an easy way for a user to differentiate between the various chambers as discussed above. Further it allows clearance for various pouch assembly and transfer systems to interact with the fitment 58 of the first chamber 58 without excessive interface from other portions and features of the pouch 50.

With respect to FIGS. 14-16, the first second and third chambers 52 54 92 each have a width W. The width W of the chambers 52 54 92 is determined depending on the desired product to be contained in the various chambers 52 54 92, and where it is anticipated that a user will want to keep the pouch 50. For example, the width W could be designed so as to allow the pouch 50 to fit into a standard shirt breast pocket, a standard front or rear jeans pocket, a standard coat pocket etc. These standard measurements could be obtained by survey of users and their respective attire. For example, mean's jeans size in a 25-75 percentile size range.

Figure 17:
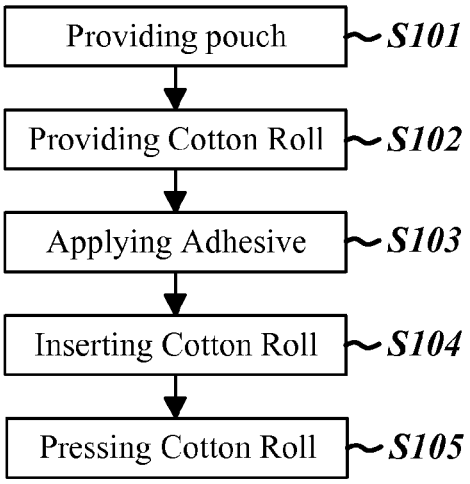
FIG. 17 is a flow chart illustrating another method of making a flexible pouch with an absorbent material.

The method of manufacturing a flexible pouch with a secured absorbent material is shown in the flow chart in FIG. 17, and includes the following steps. Step S101, providing a flexible pouch with a chamber having an opening and a bottom. The provided pouch may be similar to those described above. Step S102, proving a generally cylindrical shaped piece of absorbent material with an end. Again, similar to above, such as a cotton roll. Step S103, applying adhesive to the end of the absorbent material. This step may be done by hand, or by machine. The adhesive can be any glue, epoxy, etc, known to those skilled in the art suitable for use with the absorbent material and the flexible pouch. Step S104, inserting the absorbent material into the flexible pouch through the opening. This may be done by hand or by machine. When inserted, the absorbent material should align with the opening, as described above. Step S105, pressing the end of the absorbent material against the bottom of the chamber. This step may be done by hand or machine, pressure should continue until the adhesive material bonds sufficiently to retain the absorbent material in place within the flexible pouch.

Substitutions and interchangeable design elements exist between the shown embodiments. For example, the conventions of first, second and third chamber are arbitrary and may be rearranged with the absorbent material in the second chamber, the partial tear away portion on the first chamber, etc. The various features may used in combinations beyond shown in the figures, such as the cotton roll absorbent material being used with a three chambered pouch, etc.

The present invention has been described in an illustrative manner. It is to be understood that the terminology which has been used is intended to be in the nature of words of description rather than limitation. Many modifications and variations of the present invention are possible in light of the above teachings.

The invention claimed is:

1. A flexible pouch comprising:

a first chamber separated from a second chamber by a seal;

said first chamber having a first fitment with an opening permitting access to the first chamber, said first chamber having an absorbent material affixed to the pouch, wherein the absorbent material is generally cylindrical in shape and includes an end.

2. The flexible pouch of claim 1 further comprising:

the first chamber including a bottom portion; and the end of the generally cylindrical shape of the absorbent material is secured to the bottom portion of the first chamber.

3. The flexible pouch of claim 2 further comprising:

the opening of the first fitment defined by an inside surface of the first fitment, the opening in the first fitment providing access to the first chamber, and the opening of the first fitment having an axis generally aligned with an axial direction of the inside surface of the fitment;

the absorbent material having an axis general aligned with an axial direction of the generally cylindrical shape; and the axis of the absorbent material is generally parallel to the axis of the opening of the fitment.

4. The flexible pouch of claim 3 wherein an inside surface defining the opening of the fitment of the first chamber has an elongated generally oval shape.

5. The flexible pouch of claim 1 wherein the second chamber further comprises a fitment with an opening for access to contents contained in the second chamber.

6. The flexible pouch of claim 5 further compromising: the second chamber including a top edge, a side edge and an angled edge, the angled edge located between the top edge and the side edge; wherein the fitment of the second chamber is located along the angled edge.

7. The flexible pouch of claim 1 further comprising: the first chamber having a top edge; the flexible pouch having a bottom edge; and the second chamber having a top edge; wherein a distance between the top edge of the first chamber and the bottom edge of the flexible pouch is greater than a distance between the top edge of the second chamber and the bottom edge of the flexible pouch.

8. The flexible pouch of claim 1 further comprising: a third chamber separated from the first chamber by a seal.

9. The flexible pouch of claim 8 wherein the third portion includes a tear off portion.

10. The flexible pouch of claim 8 wherein a width of the first chamber, a width of the second chamber and a width of the third chamber are small enough to allow the flexible pouch to fit into a pant pocket of an average user when the flexible pouch is folded along the seal separating the first chamber from the second chamber.

11. The flexible pouch of claim 1 wherein a front panel is sealed to a back panel to enclose a volume; and the first chamber is defined by the volume enclosed by a portion of the front panel and back panel.

12. The flexible pouch of claim 11 wherein the seal includes a perforation running along its length.

13. The flexible pouch of claim 11 further comprising:

the first chamber including a bottom portion; and the end of the generally cylindrical shape of the absorbent material is secured to the bottom portion of the first chamber.

14. The flexible pouch of claim 11 wherein the second chamber further comprises a fitment with an opening for access to contents contained in the second chamber.

15. The flexible pouch of claim 11 further comprising: a third chamber separated from the first chamber by a seal wherein the third portion includes a tear off portion.

16. The flexible pouch of claim 1 further comprising: a front panel sealed to a back panel to enclose a first volume; wherein a middle panel is disposed between the front panel and the back panel, the middle panel sealed to the front panel to enclose a second volume; and the first chamber is defined by the second volume enclosed by a portion of the middle panel and the front panel.

17. The flexible pouch of claim 1 wherein a width of the first chamber and a width of the second chamber are small enough to allow the flexible pouch to fit into a pant pocket of an average user when the flexible pouch is folded along the seal separating the first chamber from the second chamber.

18. The flexible pouch of claim 1 further comprising: a front panel sealed to a back panel to enclose a first volume; wherein a middle panel is disposed between the front panel and the back panel, the middle panel sealed to the back panel to enclose a second volume; and the first chamber is defined by the second volume enclosed by a portion of the middle panel and the back panel.

19. The flexible pouch of claim 1 wherein the seal includes a perforation running along its length.

20. A method of manufacturing a flexible pouch with a secured absorbent material comprising:

providing a flexible pouch with chamber having an opening and a bottom;

providing a generally cylindrical shaped piece of absorbent material with an end;

applying adhesive to the end of the absorbent material;

inserting the absorbent material into the flexible pouch through the opening; and pressing the end of the absorbent material against the bottom of the chamber.

* * * * *